US007878234B2

(12) United States Patent
Lim et al.

(10) Patent No.: US 7,878,234 B2
(45) Date of Patent: Feb. 1, 2011

(54) EVAPORATOR

(75) Inventors: Hong Young Lim, Daejeon (KR); Kwang Heon Oh, Daejeon (KR); Young Jun Jee, Daejeon (KR)

(73) Assignee: Halla Climate Control Corp., Daejeon (KR)

( * ) Notice: Subject to any disclaimer, the term of this patent is extended or adjusted under 35 U.S.C. 154(b) by 892 days.

(21) Appl. No.: 11/743,705

(22) Filed: May 3, 2007

(65) Prior Publication Data

US 2007/0256820 A1 Nov. 8, 2007

(30) Foreign Application Priority Data

May 4, 2006 (KR) ..... 10-2006-0040754

(51) Int. Cl.
*F28D 1/03* (2006.01)

(52) U.S. Cl. ..... 165/153; 165/176; 165/178

(58) Field of Classification Search ..... 165/153, 165/176, 178
See application file for complete search history.

(56) References Cited

U.S. PATENT DOCUMENTS 5,058,662 A * 10/1991 Nguyen ..... 165/153
5,680,897 A * 10/1997 Kilmer ..... 165/178
5,896,916 A * 4/1999 Baechner et al. ..... 165/153
6,047,769 A * 4/2000 Shimoya et al. ..... 165/153
6,951,244 B1 * 10/2005 Hoger ..... 165/153

* cited by examiner

*Primary Examiner*—Leonard R Leo
(74) *Attorney, Agent, or Firm*—Lowe Hauptman Ham & Berner LLP

(57) ABSTRACT

An evaporator comprises tubes, configured for coolant flow, stacked in regularly spaced relation to one another, each of the tubes formed by coupled tube plates. Also comprising a tank in fluid communication with the tubes at an upper or lower side; inlet and outlet end-plates which respectively have an inflow part and an outflow part at an upstream side of coolant flow and positioned at respective end sides of the stacked tubes; and inlet and outlet manifolds in fluid communication with the tank and coupled to the inflow and outflow parts to define a coolant flow passage. The outlet manifold has a coolant movement preventing part isolating a rear portion from the coolant flow passage and comprises a closed space formed by joining the outlet end-plate and the outlet manifold to prevent formation of a dead zone where the coolant from the tank flows into a downstream side of the outlet manifold and is whirled therein.

3 Claims, 9 Drawing Sheets

EVAPORATOR

TECHNICAL FIELD

The present invention relates to an evaporator, and particularly, to an evaporator which prevents generating a dead zone that a coolant is not discharged completely and whirled in a tank when the coolant flowed the tank through a tube and then discharged through a discharging pipe connected to a manifold at a discharging side.

BACKGROUND ART

An evaporator is an apparatus for increasing a temperature of the coolant condensed and liquidized by a condenser so as to evaporate the coolant and then discharging the evaporated coolant.

In order to improve a discharging temperature, in a four-tank type evaporator, the coolant is introduced to an upper tank and flowed to a lower tank through a tube and then flowed again to the upper tank through the tube so as to be discharged.

Particularly, in case of a laminated evaporator, an end-plate is disposed at both right and left sides of the evaporator. The end-plate is formed with an inlet manifold and an outlet manifold. The condensed and liquidized coolant is introduced through the inlet manifold, and the evaporated coolant heated during the ciculation in the evaporator is discharged through the outlet manifold.

In a conventional evaporator, as shown in FIGS. 1 and 2, an inlet end-plate 150 and an outlet end-plate 160 placed at both right and left sides thereof are arranged symmetrically, and an inlet manifold 151 and an outlet manifold 161 are coupled to upper sides thereof. Further, at each upstream side of the inlet end-plate 150 and the outlet end-plate 160, there are formed an inflow part 152 and an outflow part 162, respectively. Between the inlet end-plate 150 and the outlet end-plate 160, there is formed a tube 120 by coupling a tube plate 121. A plurality of tubes 120 are laminated in a row, and a tank 130 communicated with the tube 120 is formed at upper and lower sides of the tube 120, and a fin 140 is interposed between the tubes 120. In this situation, the tank 130 communicated with the tube 120 is connected with another tank 130 communicated with other adjacent tube 120 to be communicated with each other.

The inlet end-plate 150 and the outlet end-plate 160 are respectively formed with a communicating opening 153, 163 communicated with the tank 130.

FIG. 3 shows a flowing path of coolant in the conventional four-tank type evaporator.

The flowing path of coolant in the evaporator will be described. The liquidized coolant introduced through the inflow part 152 of the inlet end-plate 150 is flowed in the inlet manifold 151 and moved through the communicating opening 153 to the tank 130 positioned at the upper side of the tube 120 and then moved through a flowing path 122', 122" of coolant to the tank 130 positioned at the lower side of thereof. The coolant moved to the lower side through the rear flowing path 122" of coolant is moved again to the tank 130 at the upper rear side through the rear flowing path 122" of coolant so as to be flowed together. Then, the coolant is moved in a horizontal direction to the tank 130 at the upper front side and moved to the lower side while being branched off through the front flowing path 122' of coolant and then flowed together in the tank 130 at the lower front side. Sequentially, the coolant is moved again in the horizontal direction and moved to upper side while being branched off through the front flowing path 122' of coolant and then flowed together in the tank 130 at upper front side. And the coolant is flowed in the outlet manifold 161 through the communicating opening 163 formed at the outlet end-plate 160 and then discharged to the outflow part 162 of the outlet end-plate 160. By the process as described above, the liquidized coolant is evaporated and the evaporated coolant is discharged to an outlet pipe 170 through the outlet manifold 161 and the outlet end-plate 160. At this time, since the coolant is in a vapor phase at the outlet side, the coolant has a high flowing speed.

In the conventional evaporator, when the coolant which is flowed together in the tank 130 positioned at the front side through the communicating opening 163 formed at the outlet end-plate 160 flowed the outlet manifold 161 and discharged to the outflow part 162 of the outlet end-plate 160, the coolant flowed the front side of the outlet manifold 161, i.e., the upstream side of air flow as well as the rear side thereof, i.e., the downstream side of air flow. At this time, the coolant moved to the downstream side, i.e., the rear side of the outlet manifold 161 generates a whirling phenomenon indicated by a blue color in FIG. 4, and thus the flowing speed is lowed and a pressure loss is increased. As described above, at the downstream side of the outlet manifold 161, there is a dead zone which is unnecessary for the flowing of coolant. Therefore, there is a problem that the evaporated coolant having the high flowing speed forms a floating phenomenon like an open cavity due to the dead zone, thereby generating a noise.

DISCLOSURE

Technical Problem

It is an object of the present invention to provide an evaporator which prevents the dead zone from being formed at the outlet end-plate so that the evaporated coolant can be smoothly discharged and thus the generation of noise is prevented.

Technical Solution

The foreging and/or other aspects of the present invention can be achieved by providing an evaporator includes a plurality of tubes in which a flowing path of coolant is formed by two coupled tube plates and which are laminated in a row at a predetermined interval; fins interposed between the tubes; a tank communicated with the tube at an upper or lower side of the tube; an inlet end-plate and an outlet end-plate which have an inflow part and an outflow part at an upstream side thereof and which are positioned at both right and left sides of the laminated tubes; and an inlet manifold and an outlet manifold which are communicated with tank and also coupled to the inflow part and the outflow part so as to define the flowing path of coolant, wherein the outlet manifold and/or the end part, connected with the outlet manifold, of the outlet end-plate has the coolant movement preventing part which prevents the formation of the dead zone in which the coolant from the tank communicated with the adjacent tube flowed a downstream side of the outlet manifold and then whirled therein.

Preferably, the coolant movement preventing part isolates a rear side, i.e., a downstream side of the outlet manifold from the flowing path of coolant.

Preferably, the coolant movement preventing part comprises a closed space formed by the outlet end-plate and the outlet manifold.

Preferably, the coolant movement preventing part comprises an insolating part which is positioned at a front side of the space and formed by the outlet end-plate and the outlet manifold so as to isolate the space.

Preferably, the coolant movement preventing part comprises a flat type hermetic part formed by the outlet end-plate and the outlet manifold.

DETAILED DESCRIPTION OF MAIN ELEMENTS

| | |
|---|---|
| 10: | inlet pipe |
| 20: | tube |
| 21: | tube plate |
| 22: | flowing path of coolant |
| 22': | front flowing path of coolant |
| 22": | rear flowing path of coolant |
| 30, 30a, 30b, 30c: | tank |
| 40: | fin |
| 50: | inlet end-plate |
| 51: | inlet manifold |
| 52: | inflow part |
| 53: | communicating opening |
| 60: | outlet end-plate |
| 61: | outlet manifold |
| 62: | outflow part |
| 63: | communicating opening |
| 64: | coolant movement preventing part |
| 64a: | space |
| 64b: | isolating part |
| 64c: | flat type hermetic part |
| 70: | outlet pipe |

BEST MODE

Now, the evaporator according to the present invention will be described with reference to the drawings.

Figure 1:
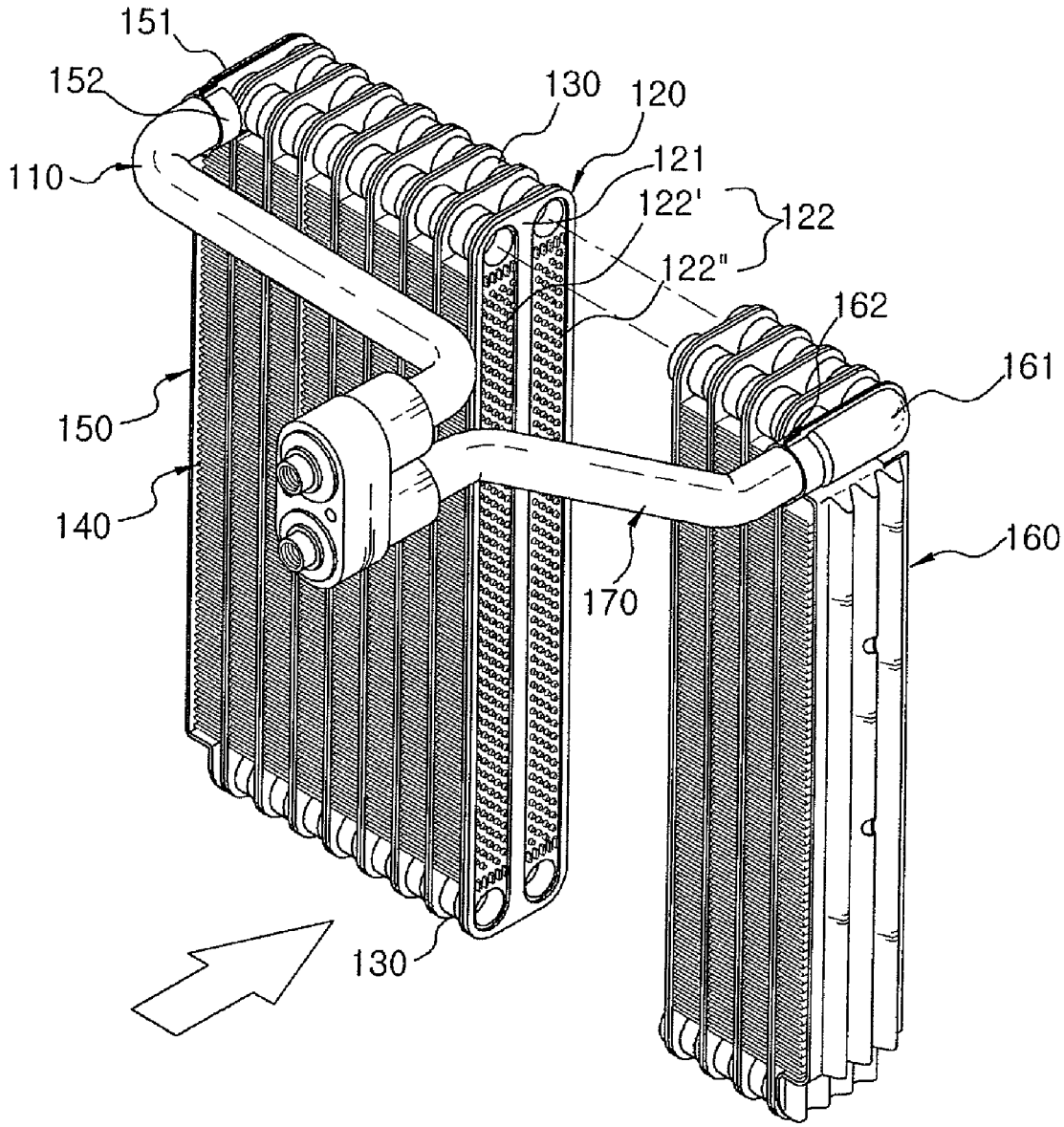
Fig.1 (PRIOR ART)
FIG. 1 is a perspective view showing a conventional evaporator.
Figure 2:
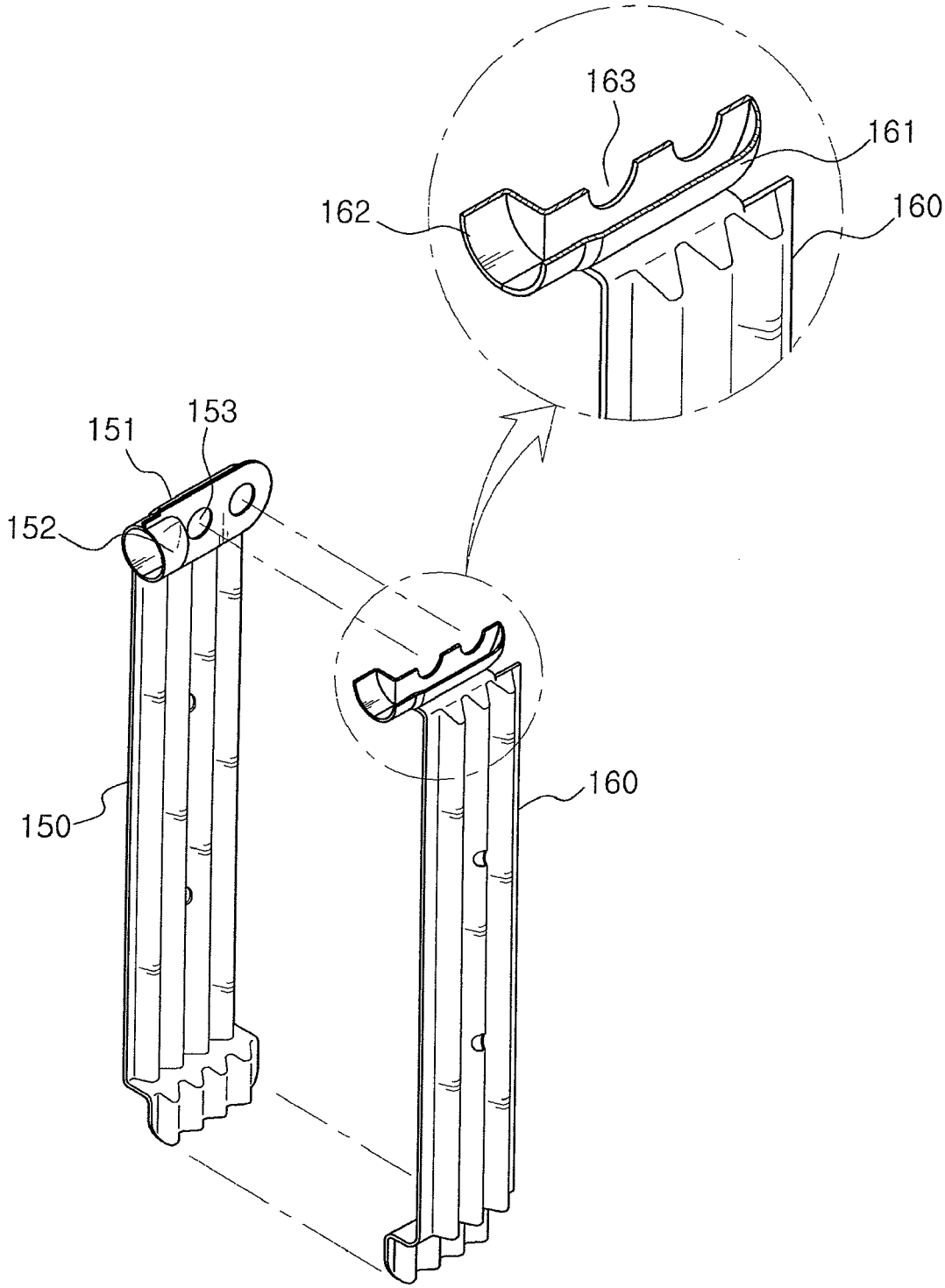
FIG.2 (PRIOR ART)
FIG. 2 is a perspective view showing a structure of an end-plate in the conventional evaporator.
Figure 3:
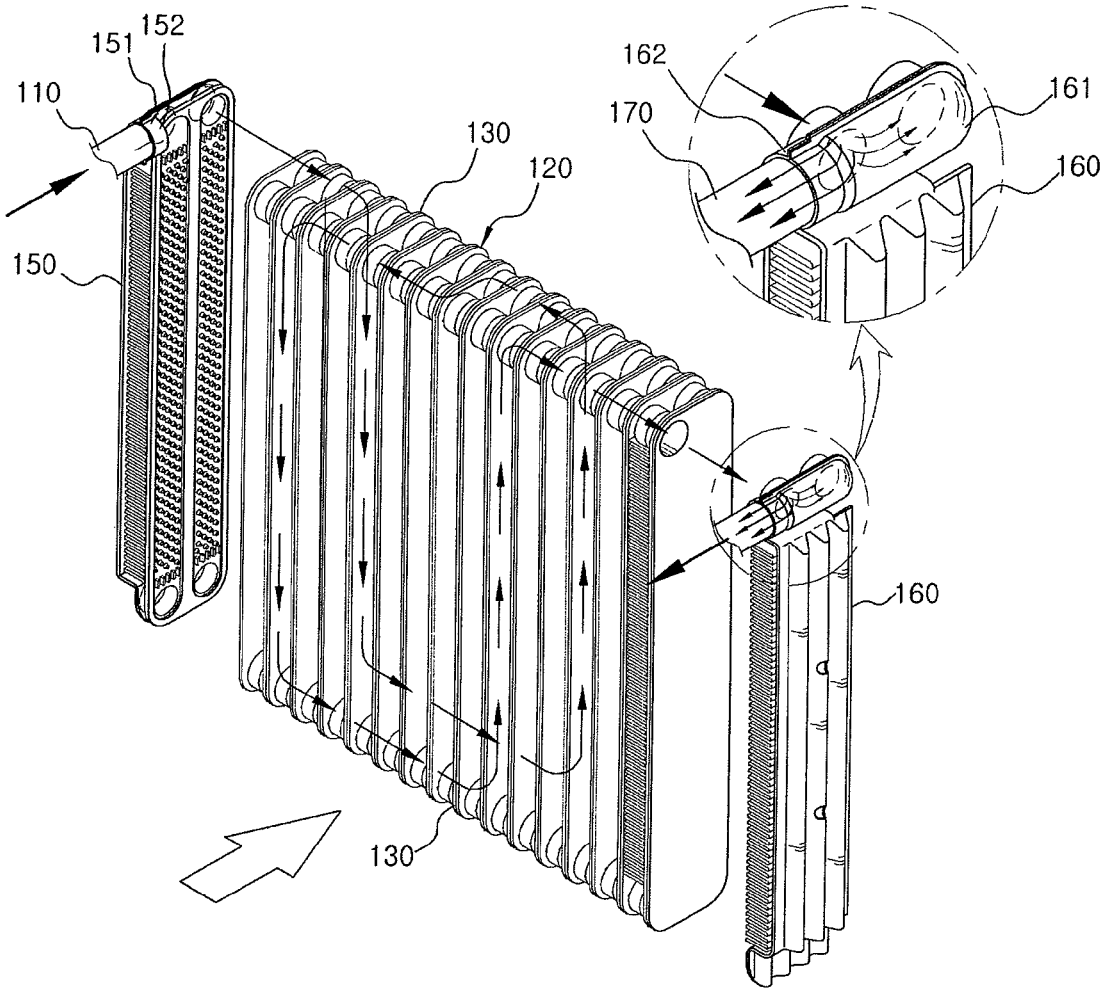
Fig.3 (PRIOR ART)
FIG. 3 is a perspective view showing a flowing path of coolant in a conventional four-tank type evaporator.
Figure 4:
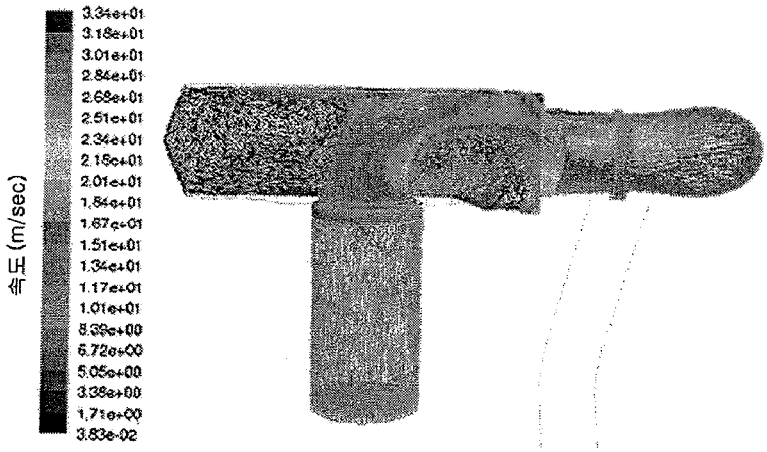
Fig.4 (PRIOR ART)
FIG. 4 is a view showing a CFD result in a status that a coolant is discharged in the conventional evaporator.
Figure 5:
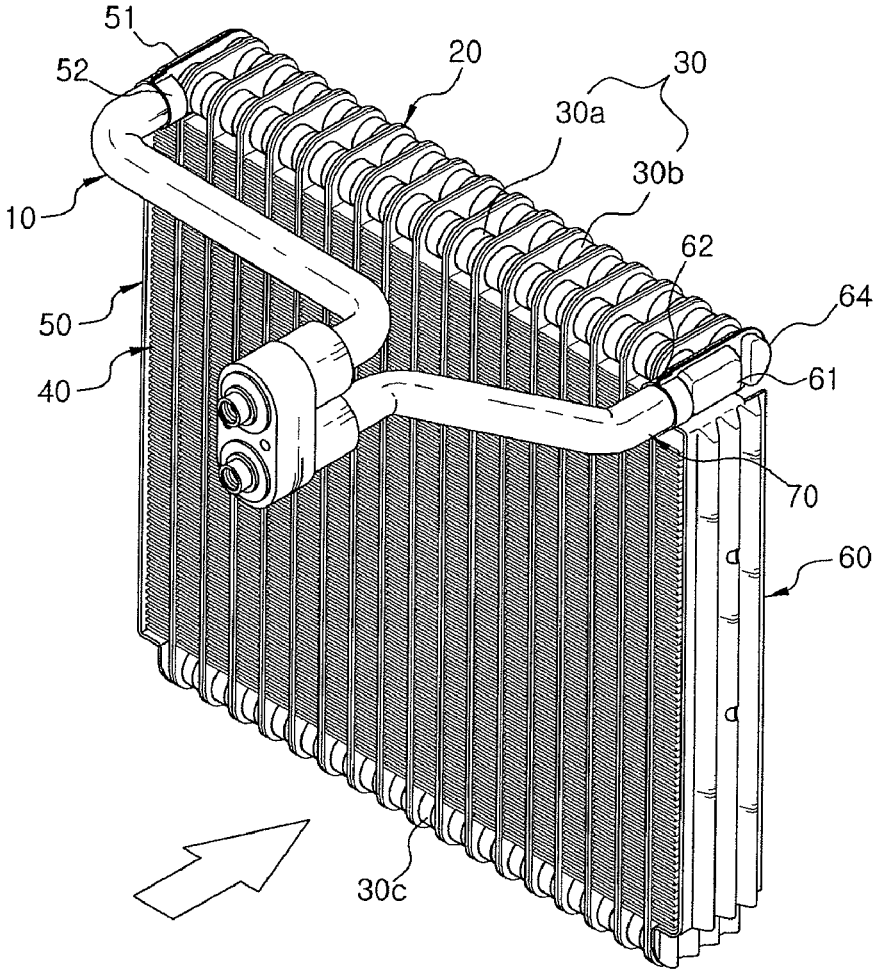
FIG. 5 is a perspective view showing an evaporator according to the present invention.
Figure 6:
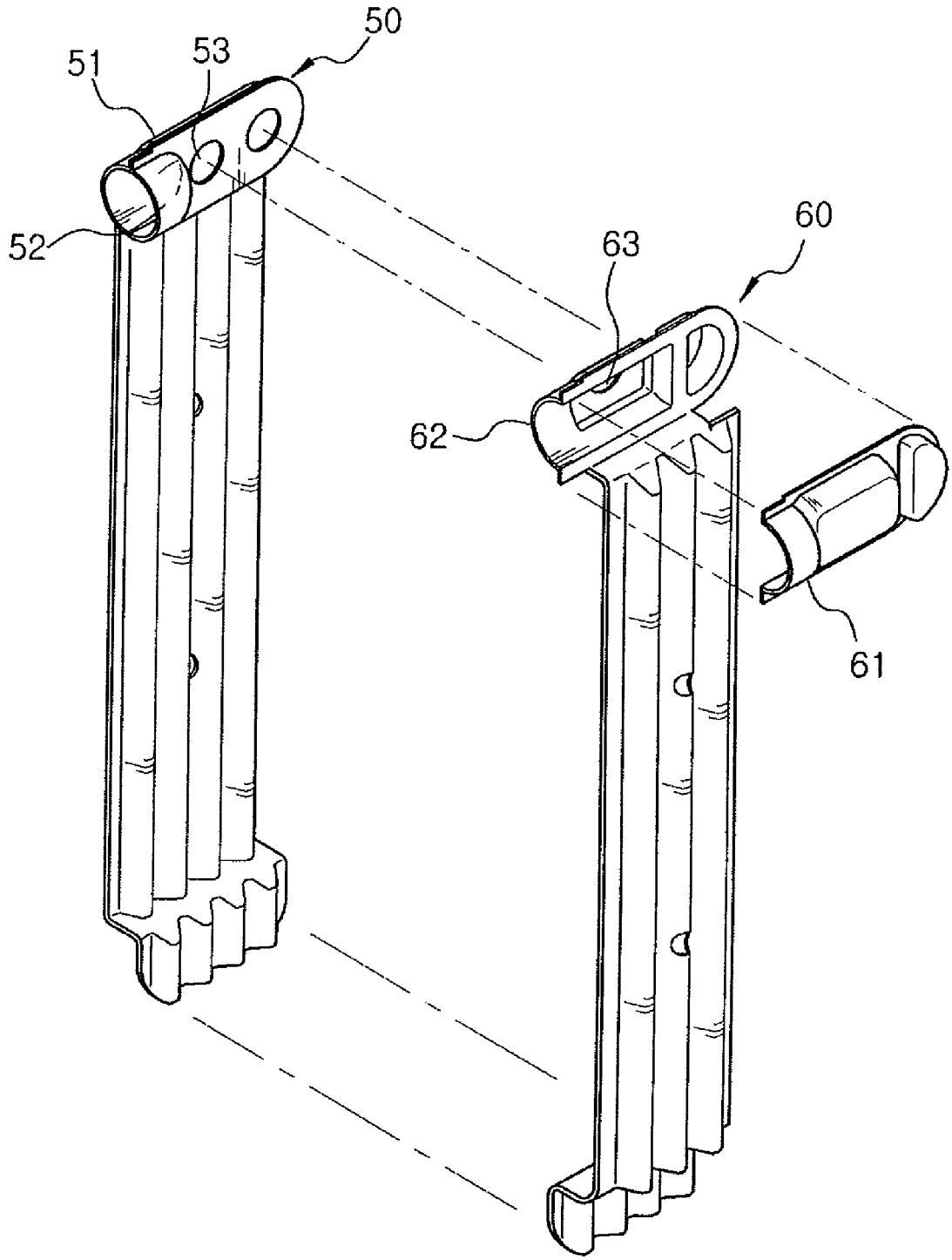
FIG. 6 is a perspective view showing a structure of an end-plate in the evaporator according to the present invention.
Figure 7:
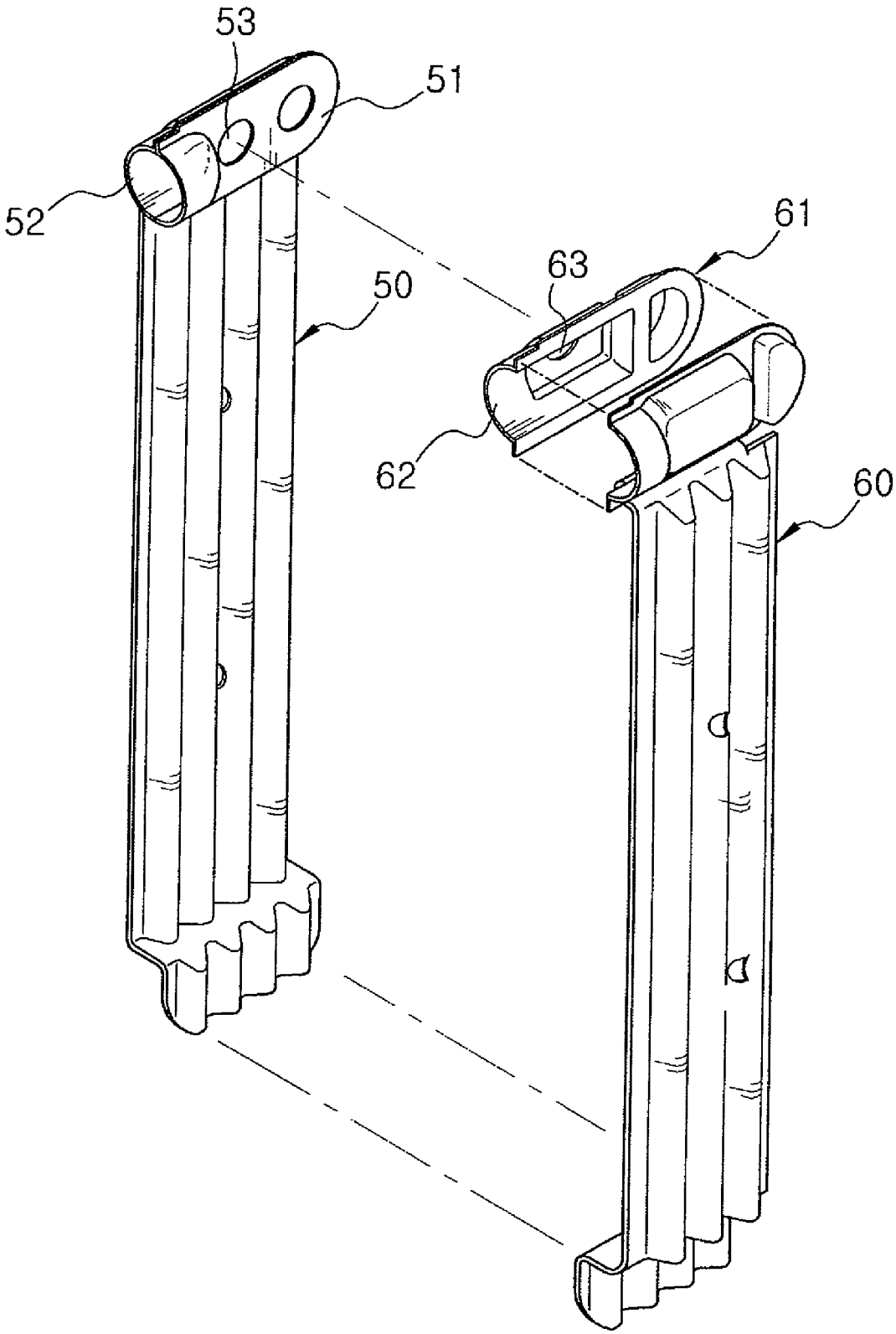
FIG. 7 is a perspective view showing a structure of an different formed end-plate in the evaporator according to the present invention.
Figure 8:
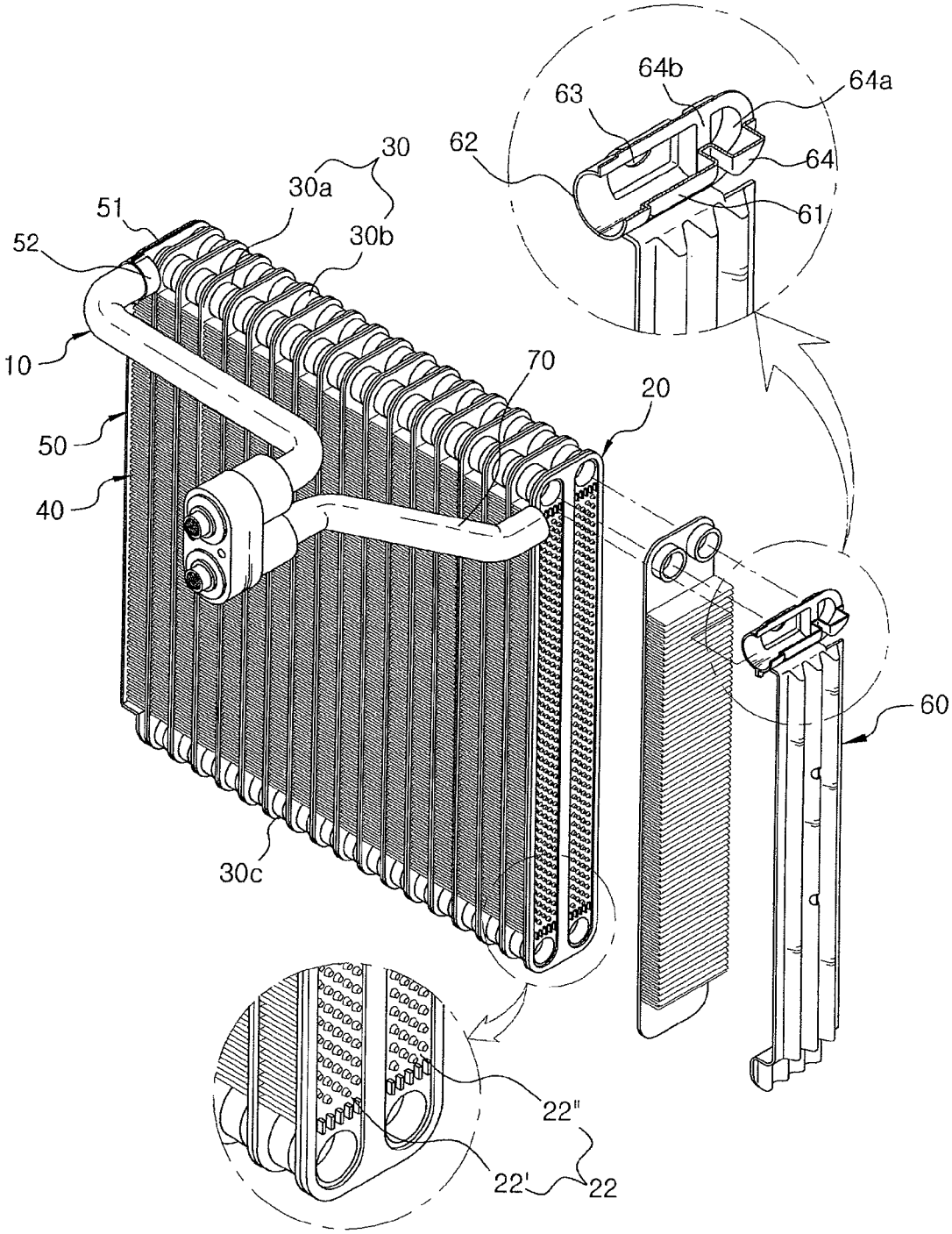
FIG. 8 is an perspective view showing a structure of an outlet end-plate in the evaporator according to the present invention
Figure 9:
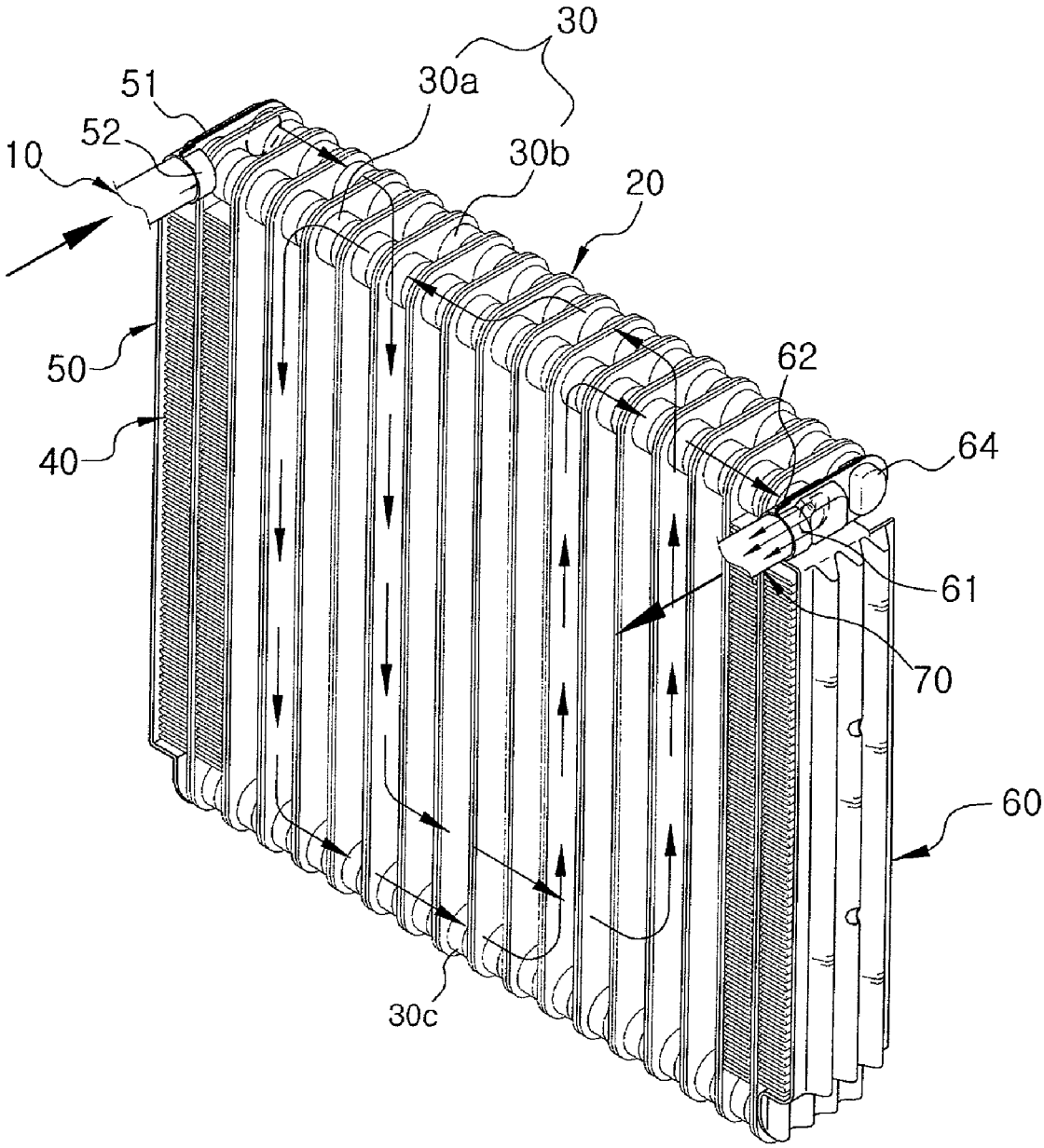
FIG. 9 and FIG. 10 are a perspective view showing a flowing path of coolant in a four-tank type evaporator according to the present invention.
Figure 10:
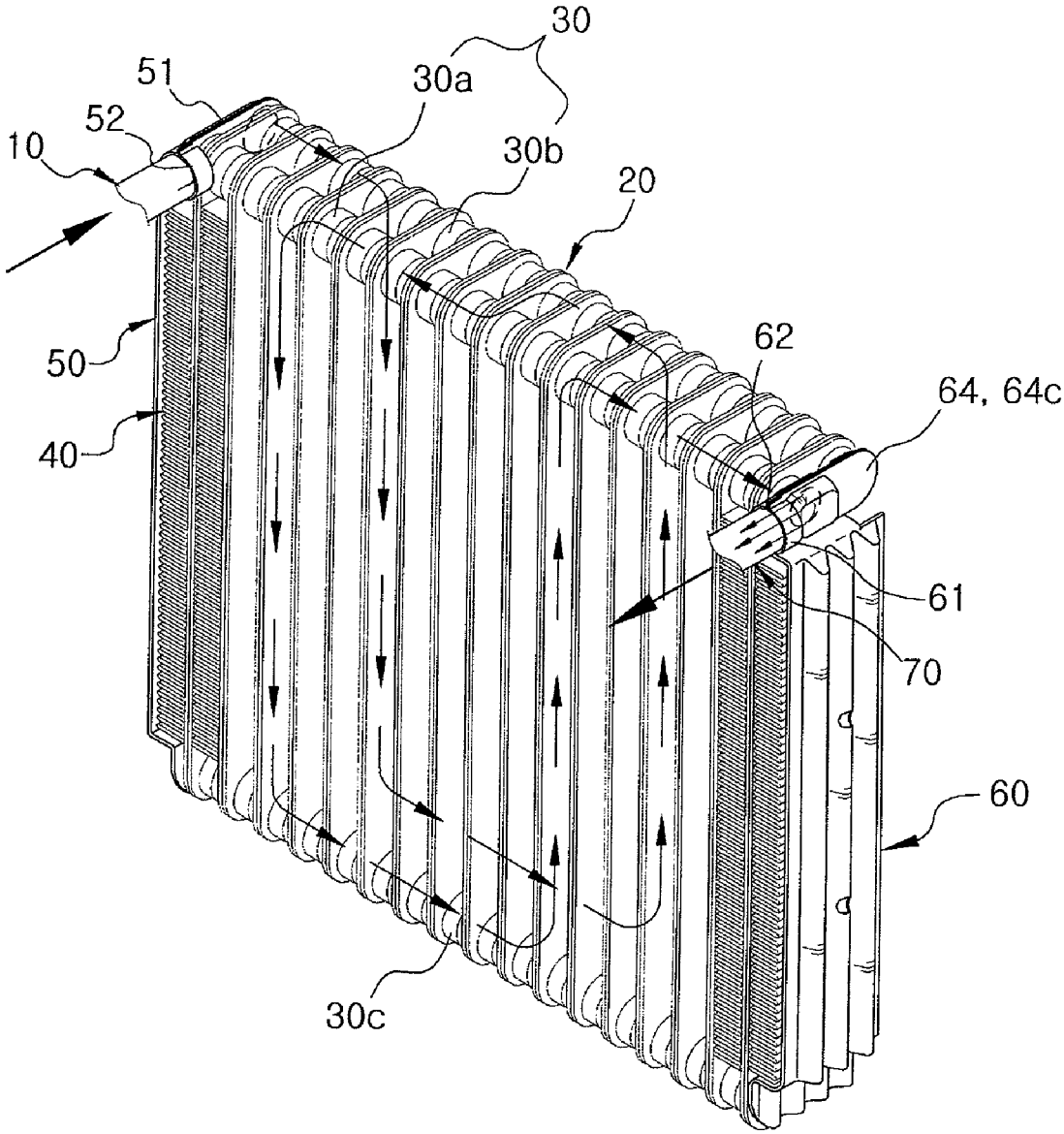

FIG. 5 is a perspective view showing an evaporator according to the present invention, FIG. 6 is a perspective view showing a structure of an end-plate in the evaporator according to the present invention, FIG. 7 is a perspective view showing a structure of an different formed end-plate in the evaporator according to the present invention, FIG. 8 is an perspective view showing a structure of an outlet end-plate in the evaporator according to the present invention, and FIG. 9 and FIG. 10 are a perspective view showing a flowing path of coolant in a four-tank type evaporator according to the present invention.

As shown in drawings, an evaporator of the present invention includes a plurality of tubes 20, a fin 40, a tank 30, inlet and outlet end-plates 50 and 60 and inlet and outlet manifold 51 and 61.

The outlet manifold 61 or outlet end-plate edge communicated with the outlet manifold 61 is characterized by having a coolant movement preventing part 64 which prevents the formation of the dead zone in which the coolant from the tank 30 communicated with the adjacent tube 20 flowed a downstream side of the outlet manifold 61 and then whirled therein.

The flowing path of coolant is formed by two coupled tube plates 21, and the plurality of tubes 20 is provided so that the fin 40 is interposed therebetween, and the tubes 20 are laminated in a row. Also the tank 30 is in fluid communication with the tube 20. An inflow part 52 and an outflow part 62 are formed to be protruded toward an upstream side of air flow, and the inlet end-plate 50 and the outlet end-plate 60 are respectively provided at both right and left sides of the laminated tube 20. The inlet manifold 51 and the outlet manifold 61 are fluidly communicated with tank and also coupled to the inflow part and the outflow part so as to define the flowing path of coolant. The outlet manifold 61 has the coolant movement preventing part 64 which prevents the formation of the dead zone in which the coolant from the tank 30 communicated with the adjacent tube 20 flowed a downstream side of the outlet manifold 61 and then whirled therein.

The tube 20 is formed by coupling the two tube plates 21 and provided with the flowing path of coolant at both front and rear sides thereof. The two tanks 30 are provided at the upper or lower side of the tube 20 so as to be communicated with the tube 20. At this time, the fin 40 is laminated between the adjacent tubes 20, and the tank 30 communicated with the tube 20 is connected with another tank 30 communicated with other adjacent tube 20. Further, at both ends of the tube 20, there are connected the end-plates 50 and 60, respectively.

The inlet manifold 51 is connected with one of the end-plates, i.e., the inlet end-plate 50 so that the coolant liquidized in a condenser is introduced. The outlet manifold 61 is connected with other end-plate, i.e., the outlet end-plate 60 so that the coolant evaporated through the tank 30 and tube 20 is discharged.

At an upper sides of the inlet end-plate 50 and the outlet end-plate 60, there are respectively provided the inlet part 52 and the outlet part 62 through which the coolant can be introduced and discharged.

At each of the upstream side and the downstream side of the the inlet end-plate 50 and the outlet end-plate 60, there is formed a communicating opening 53 communicated with the tank 30.

The tube plate 21 coupled to the inlet end-plate 50 is communicated with the downstream side of air flow so that the coolant is introduced to the tank 30 positioned at the downstream of air flow. And the tube plate 21 coupled to the outlet end-plate 60 is communicated with the upstream side of air flow so that the coolant introduced through the front flowing path 22' of coolant to the tank 30 can be discharged through the outlet part 62.

FIG. 6 is the outlet manifold positioned on upper outside of the outlet end-plate 60 communicating with it, while FIG. 7 is the outlet manifold positioned on upper inside of the outlet end-plate 60 communicating with it.

Further, the outlet manifold 61 or outlet end-plate edge communicated with the outlet manifold 61 has the coolant movement preventing part 64 by which the coolant flowed from the tank 30 communicated with the adjacent tube 20 is prevented from being moved to the downstream side of air flow in the outlet manifold 61.

When the coolant flowed in the outlet manifold 61 through the tank 30 is discharged through the outlet part 62 and an outlet pipe 70 connected with the upstream side of the outlet manifold 61, by the coolant movement preventing part 64, the coolant in the outlet manifold 61 can be completely discharged through the outlet pipe 70 without congestion in the outlet manifold 61. That is, the coolant movement preventing part 64 prevents the formation of the dead zone in which the coolant flowed the downstream side of the outlet manifold 61 and then whirled therein, and it is also prevented that the evaporated coolant having the high flowing speed forms a floating phenomenon like an open cavity due to the dead zone, thereby generating a noise.

It is preferred that the downstream side of air flow, i.e., the rear side of the outlet manifold 61 is isolated from the flowing path of coolant by the coolant movement preventing part 64. To this end, as shown in FIG. 8, the coolant movement preventing part 64 has a closed space 64*a* formed by the outlet end-plate 60 and the outlet manifold 61. As described above, if the coolant movement preventing part 64 has the closed space 64*a*, it is facile to seal off the downstream side of the outlet manifold 61, i.e., the rear side of the outlet manifold 61. Further, a weight of the outlet manifold 61 can be reduced and thus symmetrical with the inlet manifold 51.

Furthermore, the coolant movement preventing part 64 preferably has an insolating part 64*b* which positioned at a front side of the space 64*a* and formed by the outlet end-plate 60 and the outlet manifold 61 so as to isolate the space 64*a*. Alternatively, the coolant movement preventing part 64 may have a flat type hermetic part 64*c* formed by the outlet end-plate 60 and the outlet manifold 61, as shown in FIG. 10.

Now, the flowing path of coolant in a four-tank type evaporator of the present invention will be described.

As shown in FIG. 9 and FIG. 10, the coolant introduced from the inlet pipe 10 through the inlet part 52 of the inlet end-plate 50 is flowed through the communicating opening 53 of the inlet manifold 51 to a tank 30*b* positioned at an upper rear side, and then flowed to the lower side through the rear flowing path 22" of coolant.

The coolant flowed to the lower side flowed the tank (not shown), which is communicated with the rear flowing path 22" of coolant and positioned at a lower rear side, so as to be flowed together. And, the coolant is moved in a horizontal direction and moved through the rear flowing path 22" of coolant to a tank 30*b* positioned at an upper rear side, and then moved again to a tank 30*a* positioned at an upper front side after moving in the horizontal direction. Then the coolant is branched off through the front flowing path 22' of coolant positioned at a front side and flowed together in a tank 30*c* positioned at a lower front side. Sequentially, the coolant is moved again in the horizontal direction and then flowed together in the tank 30*a* while being branched off through the front flowing path 22' of coolant. And the coolant is flowed in the outlet manifold 61 and then discharged to the outflow part 62 of the outlet end-plate 60.

By the process as described above, the liquidized coolant is evaporated and the evaporated coolant is discharged to the outlet part 62 of the outlet end-plate 60. At this time, since the coolant movement preventing part 64 is provided at the downstream side of the outlet manifold 61, the evaporated coolant is not moved to the rear side of the outlet manifold 61, but discharged to the outlet part 62 of the outlet end-plate 60. As described above, the present invention prevents the formation of the dead zone in which the coolant flowed a downstream side of the outlet manifold 61 and then whirled therein, whereby the coolant can be smoothly discharged and thus the generation of noise is prevented.

INDUSTRIAL APPLICABILITY

According to the present invention, when the coolant is discharged from the tank to the outlet pipe through the outlet manifold and end-plate, the coolant in the outlet manifold 61 can be completely discharged without congestion in the outlet manifold 61. Therefore, it is also prevented that the evaporated coolant having the high flowing speed forms a floating phenomenon like an open cavity due to the dead zone, thereby generating a noise.

Those skilled in the art will appreciate that the conceptions and specific embodiments disclosed in the foregoing description may be readily utilized as a basis for modifying or designing other embodiments for carrying out the same purposes of the present invention. Those skilled in the art will also appreciate that such equivalent embodiments do not depart from the spirit and scope of the invention as set forth in the appended claims.

The invention claimed is:

1. An evaporator, comprising:

a plurality of tubes stacked in regularly spaced relation to one another and configured to have coolant flowing therethrough, each of said tubes being formed by two coupled tube plates;

fins interposed between the tubes;

a tank joined to and configured to be in fluid communication with the plurality of tubes at an upper or lower side of the plurality of tubes;

an inlet end-plate and an outlet end-plate which respectively have an inflow part and an outflow part at an upstream side of coolant flow and which are positioned at respective end sides of the stacked tubes; and an inlet manifold and an outlet manifold which are joined to and configured to be in fluid communication with the tank and also coupled to the inflow part and the outflow part so as to define a coolant flow passage, wherein the outlet manifold has a coolant movement preventing part which isolates a rear portion of the outlet manifold from the coolant flow passage and comprises a closed space formed by joining the outlet end-plate and the outlet manifold to prevent formation of a dead zone in which the coolant from the tank, joined to and in fluid communication with an adjacent tube, flows into a downstream side of the outlet manifold and is whirled therein.

2. The evaporator as set forth in claim 1, wherein the coolant movement preventing part comprises an isolating part which is positioned at a front side of the closed space and formed by joining the outlet end-plate and the outlet manifold so as to isolate the closed space.

3. The evaporator of claim 1, the rear portion of the outlet manifold comprising a downstream side of the outlet manifold.

* * * * *